US009853338B2

(12) United States Patent
Baur

(10) Patent No.: US 9,853,338 B2
(45) Date of Patent: Dec. 26, 2017

(54) HIGH FREQUENCY SIGNAL FEED THROUGH

(71) Applicant: VEGA GRIESHABER KG, Wolfach (DE)

(72) Inventor: Roland Baur, Koenigsfeld (DE)

(73) Assignee: Vega Grieshaber KG, Wolfach (DE)

( * ) Notice: Subject to any disclaimer, the term of this patent is extended or adjusted under 35 U.S.C. 154(b) by 84 days.

(21) Appl. No.: 14/880,315

(22) Filed: Oct. 12, 2015

(65) Prior Publication Data

US 2016/0164154 A1 Jun. 9, 2016

(30) Foreign Application Priority Data

Dec. 4, 2014 (EP) ..... 14 196 411

(51) Int. Cl.

| | |
|---|---|
| ***H01P 1/04*** | (2006.01) |
| ***H01P 1/202*** | (2006.01) |
| ***H01R 24/42*** | (2011.01) |
| ***H01R 24/54*** | (2011.01) |

(52) U.S. Cl.

CPC ..... *H01P 1/045* (2013.01); *H01P 1/202* (2013.01); *H01R 24/42* (2013.01); *H01R 24/54* (2013.01)

(58) Field of Classification Search

CPC .. H01P 1/045; H01P 3/06; H01P 5/026; H01P 1/202; H01R 24/42; H01R 24/54

USPC ..... 333/245, 246, 260

See application file for complete search history.

(56) References Cited

FOREIGN PATENT DOCUMENTS

| | | | |
|---|---|---|---|
| CN | 1 623 254 | A | 6/2005 |
| CN | 102 798 438 | A | 11/2005 |
| CN | 101 083 375 | A | 12/2005 |
| DE | 29 06 825 | A1 | 2/1979 |
| DE | 42 06 433 | A1 | 2/1992 |
| DE | 20 2006 006359 | U1 | 4/2006 |
| DE | 10 2013 00534 | A1 | 2/2014 |
| EP | 0 161 486 | A2 | 4/1985 |

OTHER PUBLICATIONS

Machine English Translation of EPO 0161486 A2 Jun. 30, 2017.*
European search report for related application 14196411.4 dated Jun. 3, 2015.
European search report for related application 14196411.4 dated Feb. 16, 2016.

(Continued)

*Primary Examiner* — Benny Lee
*Assistant Examiner* — Jorge Salazar, Jr.
(74) *Attorney, Agent, or Firm* — Juneau & Mitchell

(57) ABSTRACT

A high frequency signal feed through by which the ends of an input side coaxial cable and an output side coaxial cable, to be connected to each other, each comprising an interior conductor and an exterior conductor surrounding the interior conductor, are coupled to each other, showing a housing, a preferably pressure-resistant signal feed through arranged in the housing for the interior conductor, with the interior conductor being coupled at a conductive structure, arranged preferably centrally in the housing and capable of handling high frequencies, with at least one element for the galvanic separation being arranged between an input side and an output side, with the housing showing the structure for the galvanically separated coupling of the exterior conductor.

14 Claims, 1 Drawing Sheet

(56) References Cited

OTHER PUBLICATIONS

European search report for related application 14196411.4 dated May 8, 2015.
Chinese office action for related application 2015 1082 4956.8, dated Mar. 2, 2017.

* cited by examiner

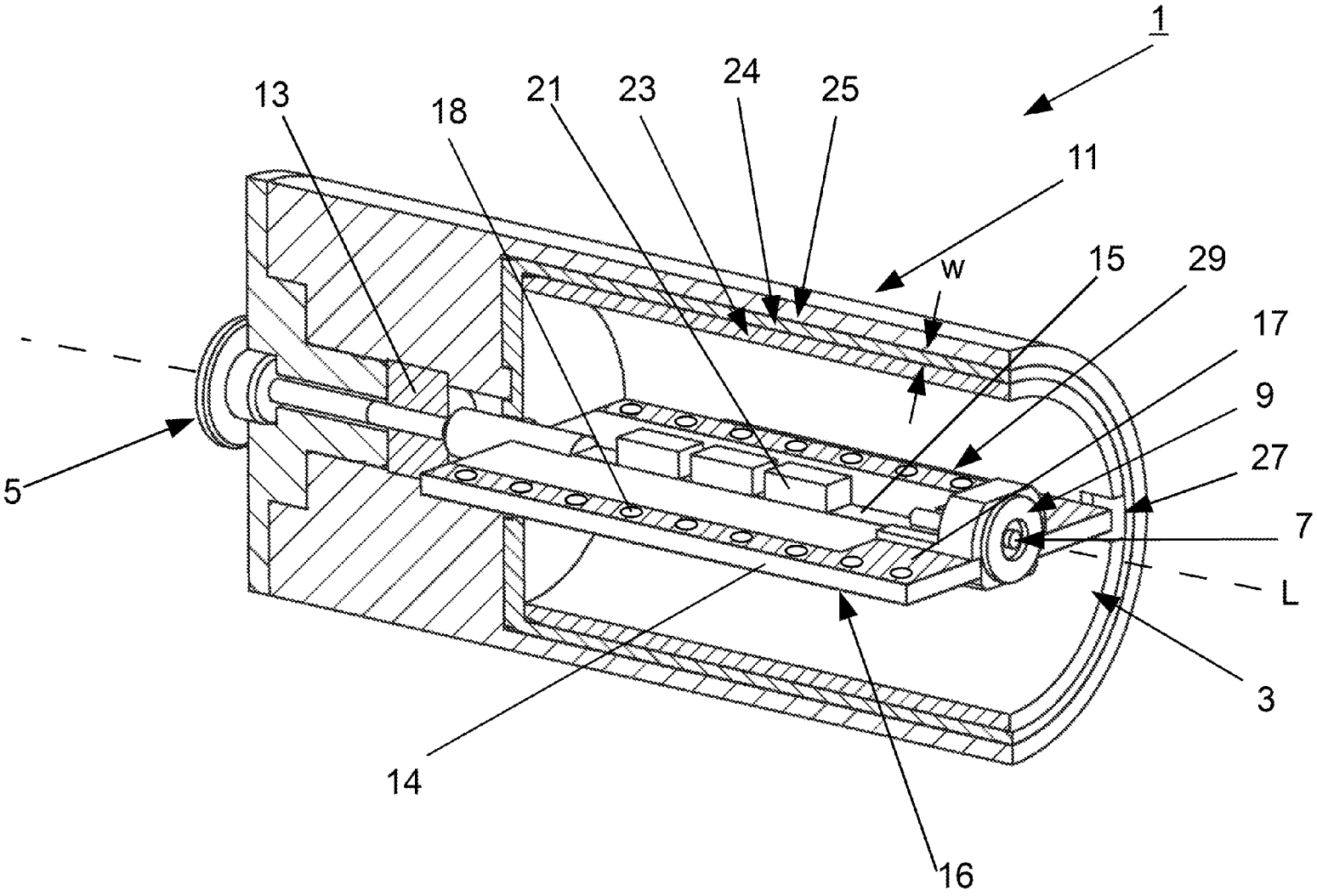
1
11
w
25
24
23
21
18
13
5
15
29
17
9
27
7
L
3
16
14

HIGH FREQUENCY SIGNAL FEED THROUGH

CROSS REFERENCE TO RELATED APPLICATIONS

This patent application claims priority to European Patent Application 14 196 411.4, filed on Dec. 4, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a high frequency signal feed through.

Background of the Invention

Appropriate high frequency signal feed through components, protected from explosions, can be used for example in devices of measuring technology, for example field devices with sensors for measuring fill levels, limits, and pressures. Appropriate high frequency signals may be for example microwave or radar signals, or signals of the field of mobile radio. In the present application, here high frequency signals are considered frequencies starting at 0.3 GHz.

A signal feed through in the sense of the present application shall relate to a connection device for connecting two conductors. Such a conductor may be an electric conductor, such as a cable, a coaxial cable, a hollow conductor, a strip line, or any other device suitable to conduct electric signals. A coaxial cable shall include in the present case both the cable as well as plugs or sockets or any other component of the coaxial line.

Field devices of measuring technology must frequently be used under rough environmental conditions. In particular, it is frequently necessary to arrange them in containers with explosive materials. In such environments it is necessary to use housings protected from explosions and thus also signal feed throughs protected from explosions, which prevent any electronics arranged inside the housing of a field device from triggering an explosion, for example by a spark. In such applications the separation must be upheld of the section in which the explosive filler material is located and for example a section in which the measuring electronic is arranged. This can be achieved, for example, by signal feed throughs protected from explosions. Any sealing of the sections is thereby ensured, for example by sealed conductor feed throughs, for example glass feed throughs or ceramic feed throughs.

Signal feed throughs known from prior art comprising ends of an above-mentioned coaxial cable to be connected and a coaxial cable coupled at the output side, each comprising an internal conductor and an external conductor surrounding the internal conductor, generally comprise a housing with a pressure-resistant signal feed through arranged in the housing for at least the interior conductor. In order to design signal feed throughs equipped with such signal feed throughs protected from explosions here a galvanic separation is necessary, which is generally implemented via discrete components, for example condensers or transmitters. In particular the connection of these components for the galvanic separation of the exterior conductor is unavoidably connected to inductive effects, which adversely affects the transmission features of the signal feed throughs. When using transmitters, it is further considered disadvantageous that they limit towards the top the frequency spectrum that can be transmitted.

It is the objective of the present invention to avoid parasitic inductive effect and thus provide a high frequency signal feed through, protected from explosions, with improved transmitting features.

This objective is attained in a high frequency signal feed through, protected from explosions, showing the features as described herein.

BRIEF SUMMARY OF THE INVENTION

In a preferred embodiment, a high frequency signal feed through, by which ends of an input-side coaxial cable and an output side coaxial cable to be connected to each other, each comprising an interior conductor and an exterior conductor surrounding the interior conductor, are coupled to each other, with a housing, a pressure-resistant signal feed through arranged in said housing for the interior conductor, characterized in that the interior conductor is coupled to the conductive structure, preferably arranged centrally in the housing and capable of handling high frequencies, with at least one element being arranged between an input side and an output side for the galvanic separation, with the housing showing the structure for the galvanically separated coupling of the exterior conductor.

In another preferred embodiment, the high frequency signal feed through as described herein, wherein the interior conductor is coupled to a circuit-board arranged in the housing and provided on a first side with a conductive structure capable of handling high frequencies, showing at least one separating element arranged on the circuit-board for the galvanic signal separation, with a second side of the circuit-board opposite the first side showing a second conductive structure coupled to the exterior conductor.

In another preferred embodiment, the high frequency signal feed through as described herein, wherein the exterior conductor is coupled to a third conductive structure arranged on the first side, surrounding the first conductive structure at the outside.

In another preferred embodiment, the high frequency signal feed through as described herein, wherein the second conductive structure is connected to the third conductive structure in an electrically conductive fashion, particularly via throughplatings.

In another preferred embodiment, the high frequency signal feed through as described herein, wherein the housing is embodied at least sectionally surrounding the circuit-board in the direction of a longitudinal axis in a cylindrical fashion, with the housing comprising at least one conductive interior layer and a conductive exterior layer, galvanically separated from the interior layer, which at least overlap such that they are capacitively coupled, with an exterior conductor at the input side being connected to the interior layer and an exterior conductor at the output side to the exterior layer.

In another preferred embodiment, the high frequency signal feed through as described herein, wherein the conductive exterior layer is embodied cylindrically and is galvanically separated from each other by an isolation.

In another preferred embodiment, the high frequency signal feed through as described herein, wherein the interior layer is embodied as a first cylindrical tube arranged inside the exterior layer.

In another preferred embodiment, the high frequency signal feed through as described herein, wherein the isolation is embodied as a second cylindrical tube, at the passing side preferably at least partially closed, in which the first cylindrical tube is supported.

In another preferred embodiment, the high frequency signal feed through as described herein, wherein the exterior layer is embodied as a third cylindrical tube, which preferably completely surrounds the first cylindrical tube in the direction of the longitudinal axis.

In another preferred embodiment, the high frequency signal feed through as described herein, wherein the circuit-board is supported in the first cylindrical tube.

In another preferred embodiment, the high frequency signal feed through as described herein, wherein the circuit-board is held in two grooves preferably arranged radially opposite in the first cylindrical tube.

In another preferred embodiment, the high frequency signal feed through as described herein, wherein the first cylindrical tube is formed from two half-shells, with the circuit-board placed therebetween.

In another preferred embodiment, the high frequency signal feed through as described herein, wherein the circuit-board is pressed into the first cylindrical tube.

In another preferred embodiment, the high frequency signal feed through as described herein, wherein the exterior conductor at the input side and the second conductive structure and the third conductive structure are connected in a conductive fashion to the interior layer via soldering or spring contacts.

In another preferred embodiment, the high frequency signal feed through as described herein, wherein additional electronic components are arranged on the circuit-board.

BRIEF DESCRIPTION OF THE DRAWINGS

FIG. 1 is a line drawing evidencing a longitudinal cross-section through an exemplary embodiment of a high frequency signal feed through protected from explosions.

DETAILED DESCRIPTION OF THE INVENTION

A high frequency signal feed through according to the invention, protected from explosions, by which ends of a coaxial line at the input side and ends of a coaxial line at an output side to be connected, respectively comprising an interior conductor and an exterior conductor surrounding said interior conductor, can be connected to each other, comprises a housing which is arranged in a preferably pressure-resistant signal feed through for the interior conductor. It is characterized in that the high conducting structure, capable of handling high frequencies and preferably arranged centered in the housing, is connected to the interior conductor, with at least one element for galvanic separation being arranged between an input side and an output side, with the housing showing a structure for the galvanically separated coupling of the exterior conductor. In particular, the interior conductor may be arranged in the housing and coupled at a first side to a first circuit board provided with a conducting structure, capable of handling high frequencies, comprising at least one separating element arranged on the circuit board for the galvanic signal separation.

By the design of the high frequency signal feed through, preferably protected from explosions, with a housing and a circuit board arranged in said housing, on which a conducting structure is provided, capable of handling high frequencies, for example a strip-line, it is possible to place separating elements for the galvanic signal separation, for example condensers or transmitters, on a circuit board and thus inside the housing. This way a compact and simultaneously robust unit is generated, by which its high frequency signals can be galvanically separated and transmitted between two sections protected from pressure.

For the embodiment of the strip-line a second side of the circuit board, located opposite the first side, is provided with a conducting structure coupled to the exterior conductor.

Here, with an appropriate design it can be achieved that on the one hand a signal, generally transmitted via the internal conductor, is transmitted beneficially via the strip-line using high frequency technology.

A further improvement of the technical high frequency features can be achieved when the exterior conductor additionally or alternatively is coupled to a third conducting structure, arranged on the first side and surrounding the conducting structure at the outside.

For example, when a first conducting structure is embodied as a strip-line, at the side of the circuit board carrying the strip-line, in the longitudinal direction laterally and isolated therefrom, a metallization may be provided, which is connected to the exterior conductor, so that any interferences thereby are avoided as well. This can occur particularly such that the second conducting structure and the third conducting structure are connected to each other in an electrically conducting fashion, which can be attained particularly by throughplatings. This way, the potential equalization between the bottom and the top of the circuit board is ensured.

Further, the housing may be embodied such that it surrounds the circuit board in the direction of its longitudinal axis, at least sectionally in a cylindrical fashion, with the housing showing at least one conductive, interior layer and a conductive exterior layer, separated from the interior layer in a galvanic fashion, which overlap at least such that they are capacitively coupled, with the exterior conductor at the input side being connected to the interior layer and an exterior conductor at the output side to the exterior layer. By such an embodiment of the housing, in a space-saving fashion, the circuit-board arranged inside the housing can simultaneously provide the shielding, galvanically separated coupling of the exterior conductor.

Any protection of the circuit-board arranged inside the housing from interferences from outside can be achieved in a particularly simple fashion when the interior layer and/or the exterior layer are embodied cylindrically and preferably separated from each other by an insulation. By the thickness of the isolation arranged between the interior layer and the exterior layer additionally, in a simple fashion, the electric strength of the galvanic separation can be adjusted in the area of the exterior conductor. Further, by an appropriate selection of the thickness and/or the dielectricity constant of the material used here the capacity formed and thus the electric transmission features of the "condenser" developing can be influenced.

A particularly simple embodiment can be achieved when the interior layer is embodied as a first cylindrical tube arranged inside the exterior layer. Further, the isolation may be embodied as a preferably at least partially closed, second cylindrical tube at the passing side, in which the first cylindrical tube is arranged. When the exterior layer is embodied as a third cylindrical tube, which overlaps the first cylindrical tube in the direction of the longitudinal axis, preferably completely, good capacitive coupling can be achieved between the first cylindrical tube and the third cylindrical tube, with simultaneously a compact and an extremely robust structure being created here. For this purpose, the third cylindrical tube may show a connection to the housing and/or container of a measuring device using an external thread or appropriate sealing devices.

Another simplification of the design can be achieved when the circuit-board is supported in the first cylindrical tube. Such a support may for example be realized via the insertion of the circuit-board into two grooves, preferably arranged radially opposite the first cylindrical tube. Alternatively, the first cylindrical tube may be formed from two half-shells, with the circuit-board placed between. By the press-fit here the two half-shells and the circuit-board can jointly be inserted into the second cylindrical tube and held there sufficiently securely. In addition or as an alternative to the fastening of the circuit-board in grooves of the cylindrical tubes the circuit-board can be pressed into the first cylindrical tube, i.e. it is held fixed therein via forces acting in the radial direction due to the elastic deformation of the first cylindrical tube.

In order to achieve a connection beneficial for signal technology, it may be useful for the exterior conductor at the input side and/or the second conducting structure and/or the third conducting structure to be connected in an electrically conductive fashion to the interior layer via soldering or spring contacts or other suitable means. This way, the distribution of the potential of the exterior conductor, generally the ground potential, is ensured over the entire internal layer, i.e. particularly the first cylindrical tube, with here good capacitive coupling being achieved to the exterior layer.

In the following, the present invention is explained in greater detail with reference to an exemplary embodiment illustrated in the attached figures.

DETAILED DESCRIPTION OF THE FIGURES

FIG. 1 shows a longitudinal cross-section through an exemplary embodiment of a high frequency signal feed through 1 protected from explosions, which is essentially formed as a coaxial arrangement of a first cylindrical tube 23, a second cylindrical tube 24, and a third cylindrical tube 25, and a pressure-protected signal feed through 13. A circuit board 14 is provided within the coaxial design of the high frequency signal feed through 1, which can be connected to a coaxial cable 3 at the input side. In the present exemplary embodiment a socket is shown as the coaxial cable 3 at the input side, which can contact an interior conductor 7 and an exterior conductor 9 of a coaxial cable using an appropriate plug. The interior conductor 7 of the socket is connected in an electrically conductive fashion to a first high frequency conductive structure 15, in the present case a strip-line, with the strip-line 15 extending in the longitudinal direction centrally on the circuit-board 14. In the present exemplary embodiment the strip-line 15 is interrupted by three components, for example separating elements 21, for a galvanic signal separation, and is transferred at an end of the circuit-board 14 located opposite the socket into a coaxial conductive structure, guided through the pressure-protected signal feed through 13 and coupled to a coaxial cable 5 at an output side. In the exemplary embodiment the coaxial cable 5 at the output side is embodied as a second socket.

In the present exemplary embodiment the circuit-board 14 is supported via grooves 27, positioned radially opposite, in the first cylindrical tube 23 acting as a conductive interior layer. The exterior conductor 9 of the coaxial cable 3 at the input side is coupled to a second conducting structure 16 at the bottom of the circuit-board 14, which in the present example is embodied as a full-area metallization, to a third conductive structure 17 at the top of the circuit-board 14. The third conductive structure 17 is arranged at the strip-line 15, extending parallel in the longitudinal direction thereof, and surrounds it at the exterior. By throughplatings 18 the third conductive structure 17 is further connected to the second conductive structure 16 on the bottom of the circuit-board 14 so that a potential equalization is ensured between the top and the bottom of the circuit-board 14. Further, the second conductive structure 16 and the third conductive structure 17 are coupled via the soldering 29 extending in the longitudinal direction to the conductive interior layer, i.e. the first cylindrical tube 23.

Due to the fact that the first cylindrical tube 23 completely surrounds the circuit-board 14 in the longitudinal direction, an excellent shielding from interferences is achieved from the outside. The first cylindrical tube 23 is galvanically separated via the second cylindrical tube 24, embodied as an isolation, from the third cylindrical tube 25, however capacitively coupled via the overlapping in the longitudinal direction of the first cylindrical tube 23 and the third cylindrical tube 25. In order to ensure the galvanic separation, the second cylindrical tube 24 is closed at the end in the direction of the pressure-protected signal feed through 13 except for a conductor feed through such that an electric contact is excluded in the axial direction between the first cylindrical tube 23 and the third cylindrical tube 25. The third cylindrical tube 25 is embodied in the axial direction such that it completely overlaps the first cylindrical tube 23, with it being embodied extended in the direction of the pressure-protected signal feed through 13 and provided with an increased wall strength in order to ensure a secure positioning of the signal feed through 13.

By a variation of a wall thickness w of the second cylindrical tube 24 embodied as an isolator, here the electric strength of the present arrangement and thus the maximum isolating voltage can be easily adjusted by constructive measures.

Further, there are various possibilities to support the circuit-board 14 in the first cylindrical tube 23, with here in addition to a support in grooves 27, also the embodiment of the first cylindrical tube 23 is possible with two half-shells, which are located above and below the circuit-board 14. Further, it is possible to impress the circuit-board 14 with or without any embodiment of grooves 27 into the first cylindrical tube 23 and this way to clamp it by an elastic deformation of the first cylindrical tube 23.

Alternatively, the first cylindrical tube 23 can be deformed by radial pressure to such an extent that it shows a slightly oval cross-section. Subsequently, along the longer primary axis of the oval, the circuit-board 14 is inserted and then the radial pressure is released again. The first cylindrical tube 23 here deforms back into its round shape and clamps and simultaneously contacts the circuit-board 14 at the edges. This way, an otherwise necessary soldering for the electric contacting can be waived.

LIST OF REFERENCE NUMBERS

1 High frequency signal feed through
3 Coaxial cable at the input side
5 Coaxial cable at the output side
7 Interior conductor
9 Exterior conductor
11 Housing
13 Signal feed through
14 Circuit-board
15 First conducting structure
16 Second conducting structure
17 Third conducting structure
18 Throughplatings
21 Separating element
23 Interior layer/first cylindrical tube
24 Isolation/second cylindrical tube
25 Exterior layer
27 Grooves
29 Soldering
L Longitudinal axis
w Wall thickness The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A high frequency signal feed through for coupling together ends of an input side coaxial cable and of an output side coaxial cable which are to be connected to each other, each coaxial cable consisting of an interior conductor and an exterior conductor surrounding the interior conductor, the high frequency signal feed through having a housing and a signal feed through arranged in the housing for connecting the interior conductors, wherein each of the interior conductors are coupled to a conductor structure of the signal feed through suitable for high frequency signal propagation which is arranged centrally in the housing, wherein the housing has at least one conductive interior layer and one conductive exterior layer which is isolated from the at least one conductive interior layer, and a circuit-board is arranged in the housing, on which circuit-board the conductor structure suitable for high frequency signal propagation is provided and at least one separating element for electrical signal separation is arranged between an input side and an output side of the high signal frequency feed, wherein an input side exterior conductor is connectable to the at least one conductive interior layer and an output side exterior conductor is connectable to the one conductive exterior layer, wherein the signal feed through is arranged in the housing in a pressure-resistant manner and the housing is formed in such a way that the housing surrounds the circuit-board cylindrically in the direction of a longitudinal axis, wherein the at least one conductive interior layer and the one conductive exterior layer are formed to overlap each other cylindrically and are isolated from each other by an insulator, such that the at least one conductive interior layer and the one conductive exterior layer are capacitively coupled, wherein the circuit-board has a first conducting structure suitable for high frequency on a first side of the circuit board, wherein the circuit-board has a second conducting structure on a second side opposite the first side, and has a third conducting structure arranged on the first side and surrounding the first conducting structure on an outer side, wherein the second conducting structure and/or the third conducting structure are connected to the at least one conductive interior layer in an electrically conductive manner via soldering or spring contacts.

2. The high frequency signal feed through of claim 1, wherein each of the interior conductors are coupled to the circuit-board and are coupled to the at least one separating element arranged on the circuit-board for the electrical signal separation, wherein the second conducting structure is coupled to each of the exterior conductors.

3. The high frequency signal feed through of claim 2, wherein the second conducting structure is connected to the third conducting structure in an electrically conductive fashion via throughplatings.

4. The high frequency signal feed through of claim 1, wherein the exterior conductors are coupled to the third conducting structure.

5. The high frequency signal feed through of claim 1, wherein the one conductive exterior layer is formed in a cylindrical fashion and is separated from the at least one conductive interior layer by the insulator.

6. The high frequency signal feed through of claim 5, wherein the insulator is embodied as a second cylindrical tube, on an output side and at least partially closed at one end thereof, and wherein the at least one conductive interior layer is embodied as a first cylindrical tube and is supported by the second cylindrical tube.

7. The high frequency signal feed through of claim 5, wherein the at least one conductive interior layer is embodied as a first cylindrical tube arranged inside the one conductive exterior layer.

8. The high frequency signal feed through of claim 7, wherein the one conductive exterior layer is embodied as a third cylindrical tube, which completely surrounds the first cylindrical tube in the direction of a longitudinal axis.

9. The high frequency signal feed through of claim 7, wherein the circuit-board is supported in the first cylindrical tube.

10. The high frequency signal feed through of claim 9, wherein the circuit-board is pressed into the first cylindrical tube.

11. The high frequency signal feed through of claim 9, wherein the circuit-board is held in two grooves arranged radially opposite to each other in the first cylindrical tube.

12. The high frequency signal feed through of claim 9, wherein the first cylindrical tube is formed from two half-shells, between which the circuit-board is placed.

13. The high frequency signal feed through of claim 1, wherein additional electronic components are arranged on the circuit-board.

14. The high frequency signal feed through of claim 1, wherein the exterior conductor at an input side is connected in a conductive fashion to the at least one conductive interior layer via soldering or spring contacts.

* * * * *